United States Patent [19]

Agyagos

[11] 4,200,282

[45] Apr. 29, 1980

[54] MULTIPLE EXERCISER DEVICE

[76] Inventor: Ferenc I. Agyagos, Sangin Bldg., 3-21-5, Akasaka, Minato-ku, Tokyo, Japan

[21] Appl. No.: 957,842

[22] Filed: Nov. 6, 1978

[30] Foreign Application Priority Data

| | | | |
|---|---|---|---|
| Dec. 16, 1977 | [JP] | Japan | 52/169248[U] |
| Dec. 16, 1977 | [JP] | Japan | 52/169249[U] |
| Feb. 3, 1978 | [JP] | Japan | 53/013247[U] |
| Feb. 3, 1978 | [JP] | Japan | 53/003741[U] |
| Feb. 3, 1978 | [JP] | Japan | 53/003742[U] |

[51] Int. Cl.[2] ..... A63B 23/02

[52] U.S. Cl. ..... 272/146; 128/25 B

[58] Field of Search ..... 272/146, 134, 93, DIG. 4, 272/144; 128/24 R, 25 R, 25 B

[56] References Cited

U.S. PATENT DOCUMENTS

| | | | |
|---|---|---|---|
| 1,952,830 | 3/1934 | Wrobley | 272/146 X |
| 3,384,369 | 5/1968 | Rumell | 272/146 X |
| 3,419,732 | 12/1968 | Lane | 272/73 UX |
| 3,612,519 | 10/1971 | Larson | 272/146 |
| 3,659,844 | 5/1972 | Cummins | 272/134 |
| 3,911,907 | 10/1975 | Smith, Jr. | 272/146 X |
| 3,929,329 | 12/1975 | Rivera | 272/146 X |

FOREIGN PATENT DOCUMENTS

| | | | |
|---|---|---|---|
| 425573 | 5/1967 | Switzerland | 272/146 |

*Primary Examiner*—John D. Yasko

*Attorney, Agent, or Firm*—Stevens, Davis, Miller & Mosher

[57] ABSTRACT

A multiple exerciser device having two spaced, freely rotatable platforms upon which twisting of the body can be performed by positioning the feet on the platforms, a spring-biased jumping and running exerciser board positioned between two parallel hand gripping bars, all operatively connected to a step-up base used in the performance of twisting and turning, jumping and running, and parallel bar exercises.

19 Claims, 15 Drawing Figures

MULTIPLE EXERCISER DEVICE

Reference is also made to my co-pending application Ser. No. 957,843, filed approximately of even date herewith.

BACKGROUND OF THE INVENTION

This invention relates to a multiple body exercising device and is particularly directed to a device having a step-up base that has positioned on its surface two spaced, freely rotatable, removable platforms and a spring-biased jumping and running board, all operatively positioned between two parallel hand gripping bars, for use in the performance of various types of twisting and turning, jumping, running-in-place, and parallel bar exercises for conditioning the body.

There are many types of devices known in the art for carrying out particular exercises of the body, such as devices with spring-biased platforms, and devices with turning platforms for use in conditioning the body. With the advent of greater emphasis on the need for daily all-round exercising programs, such as light calisthenics, the prior art devices are found to lack the diversity needed for such exercising programs because several different types of exercising equipment would have to be used which would require considerable space for use and storage.

SUMMARY OF THE INVENTION

The present device solves this problem by a novel device that can be used for several important body conditioning exercises while utilizing little space for use and storage, which is an improvement over the art.

A device of this invention is adapted to support the body in a standing position on a raised rectangular box-shaped base maintained at a sufficiently reasonable height from the floor to enable the performance of jumping and running up and down exercises simulating conditions as performed on a stairway.

The jumping, running up and down, and the running-in-place exercises for the feet and the legs are performable on this device which consists of the rectangular box-like supporting base having positioned on its top surface a biased running and jumping board that is slanted in upwardly inclined position held by being hinged at one side to the surface of the supporting base.

In one embodiment, the middle portion of the top of the base is grooved so as to receive and retain the running and jumping board when it is depressed to a substantially parallel position to the surface of the supporting base. At the side opposite to the hinged attachment are a pair of push-up guide bolts inserted at convenient points in holes or openings positioned in the surface of the groove portion near the edge opposite to the hinge attachment.

The guide bolts are inserted in such a manner that approximately half of the total length of the bolt stays above the jumping and running board and the lower half under it. The upper halves of the guide bolts each has a biasing spring so as to control and to smooth the up-and-down oscillations of the running or jumping board when such exercises are being performed. The head of the bolts on the lower half of the board serves as auxiliary stopper in conjunction with a major see-saw type stopper mechanism placed under the top surface of the supporting base.

One of the heads of the bolts is purposely placed vertically above an extending arm of a performance duration meter such as a digital recording meter which records the number of running steps and jumps, whenever jolted to a depressed position, so that the amount of such type of exercise can be monitored and counted by the recording meter.

Another feature of the device which enables the twisting and flexing of the waist, sides, hip and leg regions allows positioning of the feet to a pair of circular rotating platforms placed at convenient points on the surface of the supporting base. These platforms are detachable when not in use.

These rotating platforms each has a protruding hub or turning shaft attached to the back face of the platform at the center. These turning shafts are adapted to be inserted in vertical holes or sockets which may be in the form of a set of pipe bushings positioned in the top surface of the base. A set of rotation bars or cylinders are inserted inside these sockets having a top surface to mate with the outer tip surface of the turning shafts of the platforms so that the rotational movement of the platform is through these mating surfaces. This arrangement is especially effective to cut down on abrasion and noise. With this type of alignment, as the platforms rotate along with the voluntary directional movement of the feet, various turn differentials of a circular degree are attained with relative ease, with positive control of the movement of the platform by the user.

From both ends of the surface of the base extend a pair of hand gripping support bars which may be in the form of U-shaped pipe members or bars, with the running and jumping board and the two rotating platforms in between. The bars serve as hand grips for the performance of free hand and other free lance calisthenics plus providing a firm support to the body when performing any of the aforementioned exercises. These hand gripping support bars may be detachable and/or adjustable.

In an alternate construction, the running and jumping up and down and the running-in-place exercises for the feet and the legs are performed on a device which is formed of a rectangular box-like base with bottom portion of the base pipe supported. The base has top and bottom surfaces, the top surface having projecting spaced lugs on one side of the marginal edge to which is hinged one side of rectangular running and jumping board that is biased upwardly from the top surface of the box-like base. The running and jumping board is slightly smaller than the top of the box-like stand in width and still smaller in length so that the running and jumping board can be positioned between the parallel, spaced hand gripping bars.

In this alternate construction, the push-up bolts are inserted via holes in the top surface of the supporting base. These bolts are inserted in such a manner that approximately half of the total length of the bolt stays above the base and the lower half under it. The heads of the bolts on the lower half of the base serve as convenient auxiliary stoppers in conjunction with a major see-saw type stopper mechanism placed under the top surface of the supporting base.

One of the stopper heads is purposely placed vertically above to an extending arm of a recording meter which relays the number of runs or jumps to a performance duration means, such as a digital recording apparatus, so that the amount of such type of exercise can be monitored and counted by a digital recording apparatus which is operatively positioned in the base.

Another feature of this alternate device is that a pair of circular rotating platforms are placed at convenient operating points in the surface of the running and jumping board. These rotating platforms have turning shafts that protrude from the center back surface of the platforms and are insertable into a set of three holes along a line that is central to the running and jumping board and parallel to the hinged side thereof. The turning shaft has a bearing shoulder that raises the bottom surface of the platform above the surface of the running and jumping board so that the platforms are free turning. This arrangement is especially done to cut down on abrasion and noise. With this alignment as the platform rotates along with the voluntary directional movement of the feet, various turn differentials of a circular degree are attained with relative ease. It will be appreciated that the platform turning shaft or hub may contain ball bearings or the bolt bearings may be placed between upper and lower disc plate halves which together form the platform to enhance smooth operation and turn effectiveness.

The platform of the device of this invention can be detached when not in use or they can be left attached to the running and jumping board assembly without hindering the performance of any other exercises.

Considering the easily detachable and attachable functions of the rotating platform, optimum calisthenic results and methods can be patterned by making arrangements so that these platforms can be utilized either separately or together.

The various embodiments of this invention may have a sound projection means such as a cassette tape recorder apparatus operationally positioned to the device to greatly enhance the performance of more organized and appropriate calisthenics by broadcasting a set of programmed exercising patterns and rhythms.

Accordingly, one object of the present invention is to provide an exerciser for enabling the performance of the waist, side, hip and leg training and flexing exercises.

Another object is to provide an exerciser device which enables the performance of twisting exercises with relative ease.

Still another object is to provide an exercise device that can entertain the performance of a great variety of free lance calisthenic exercises.

Yet another object is to provide an exercising device which can monitor endurance of the performer by recording the number of runs and jumps made by means of a digital counter.

Still a further object is to provide a communication means as an integral part of the device that will broadcast to the user of the device instructions, programmed exercise patterns, and rhythms.

All of the foregoing objectives are attained with an exerciser device which is characterized by simple and reliable construction, smooth operation and an appealing configuration, and yet which provides firm support for the body of the user.

Another object is to provide a height-adjustable parallel bar for exercises in combination with turning and twisting exercises in a device of simple construction and small size.

BRIEF DESCRIPTION OF THE DRAWINGS

The foregoing and other features of the invention can be appreciated from the following description and claims taken in conjunction with the accompanying drawings, in which:

Description of the Preferred Embodiments

Figure 1:
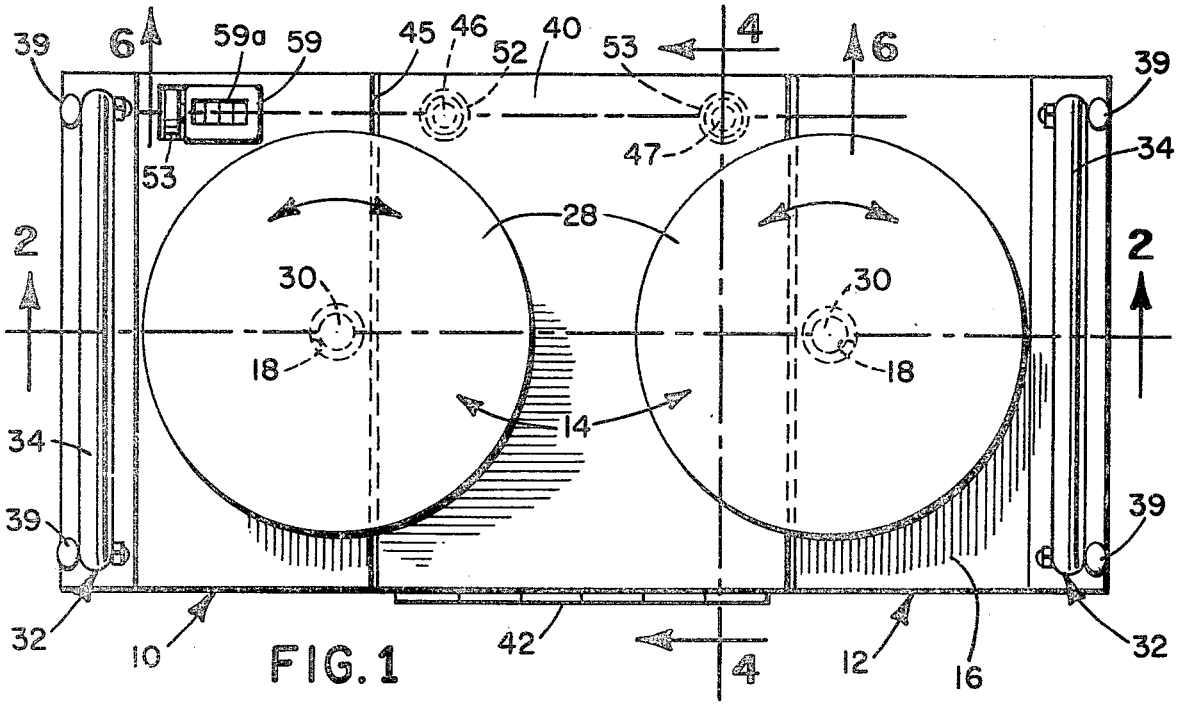
FIG. 1 is a plan view of the top of the exerciser device constructed in accordance with the invention.
Figure 2:
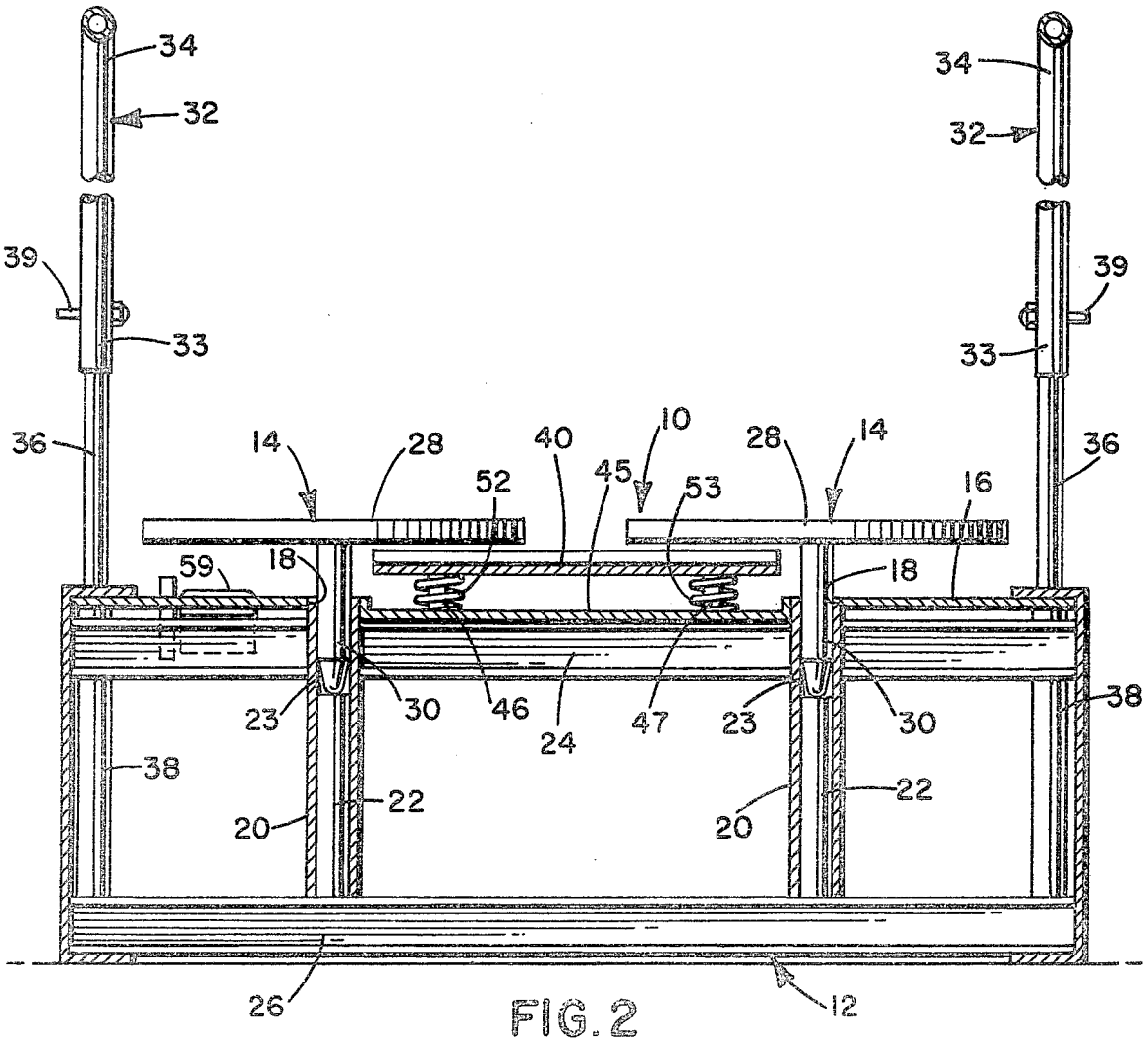
FIG. 2 is a vertical sectional view taken along the line 2—2 of FIG. 1.

Reference is now directed to FIGS. 1 and 2 which illustrate an exerciser device 10 constructed in accordance with the invention having a step-up supporting base 12 and a pair of spaced removable rotating platforms 14. On a top surface 16 of the supporting base 12 are a pair of vertically arranged holes 18 having inserted therein a pipe bushing 20 which houses a pair of cylindrical support rods 22. Each support rod is of a length less than the depth of the hole 18 to provide a deep opening or platform shaft-receiving socket 23 adapted to receive hub or platform shaft 30 of one of the rotating platforms 14 which is centrally attached to the bottom surface of the platform and is of a length longer than the depth of the deep opening 23 to enable the performance of the twisting exercises of the waist, sides, hip and the legs on the top 28 of each turntable when the platform hubs 30 are inserted in deep openings 23. The length of the rotating hub 30 provides the platform with sufficient clearance from the top surface 16 of the supporting base 12 to permit free and easy turning without contact with the top surface.

Auxiliary supporting struts 24 and 26 greatly enhance the capacity of the exerciser for heavy exercises to be performed on this device by providing a high degree of structural strength while still providing a lightweight base 12, and a device that can be used by persons of greatly different weights.

The supporting strut 26 also is responsible for maintaining inserted pipe bushings 20 and the support rods 22 firmly in their proper place.

Figure 3:
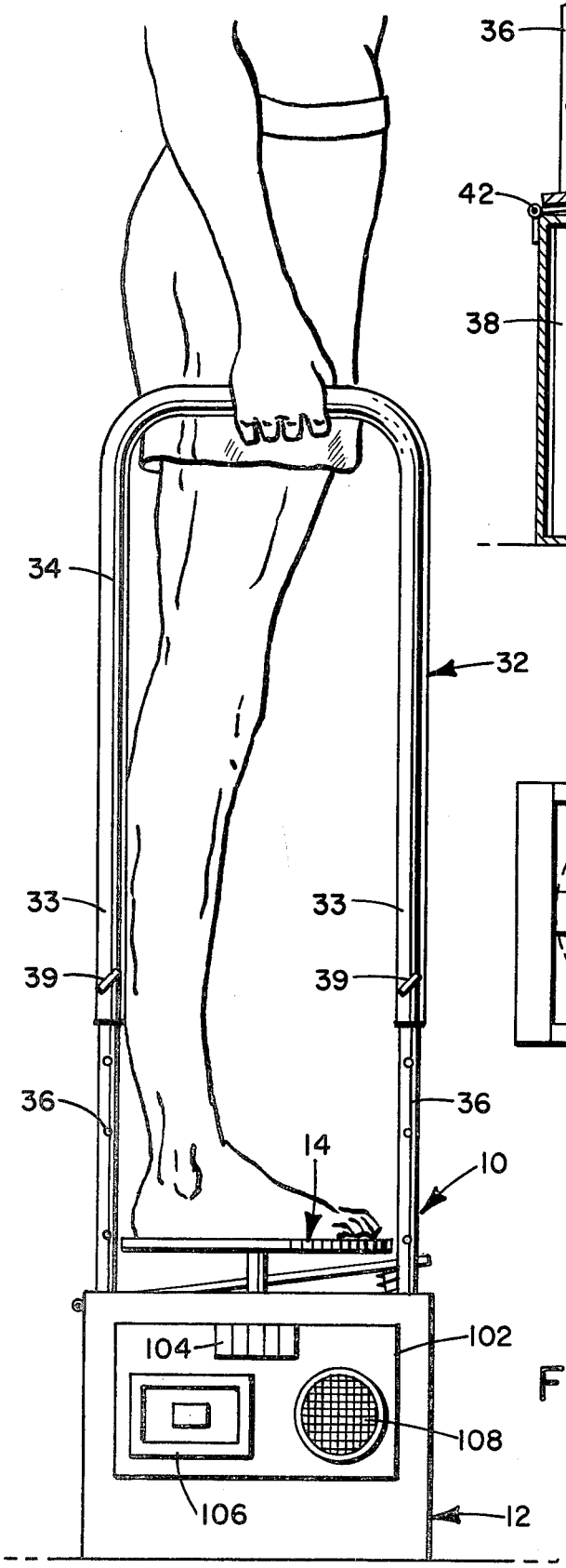
FIG. 3 is a side elevational view.
Figure 12:
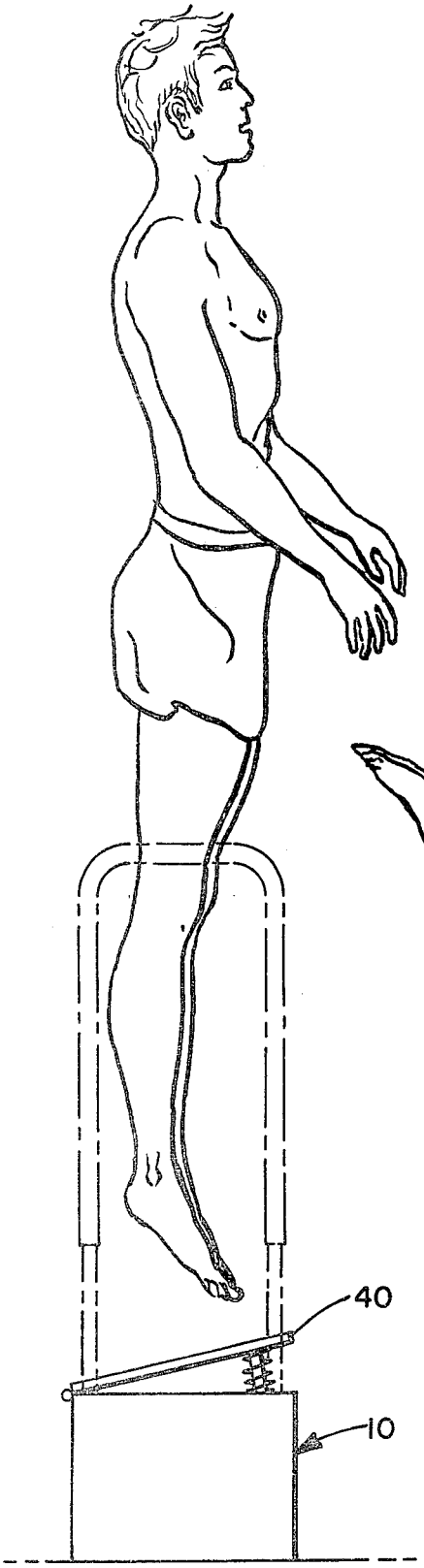
FIGS. 12 through 14 are representational views of the performance of jumping and parallel bar exercises with the device.
Figure 13:
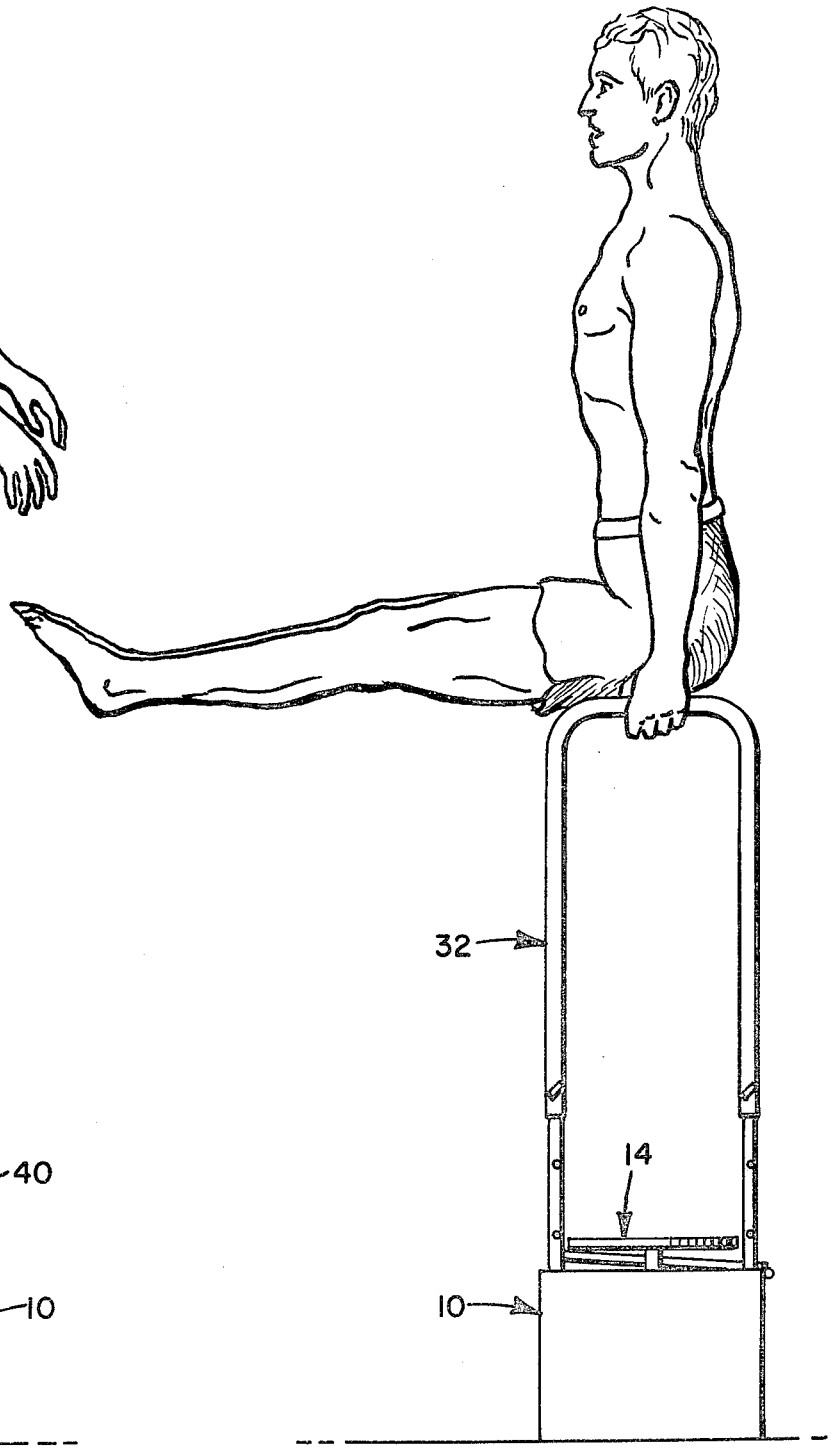
Figure 14:
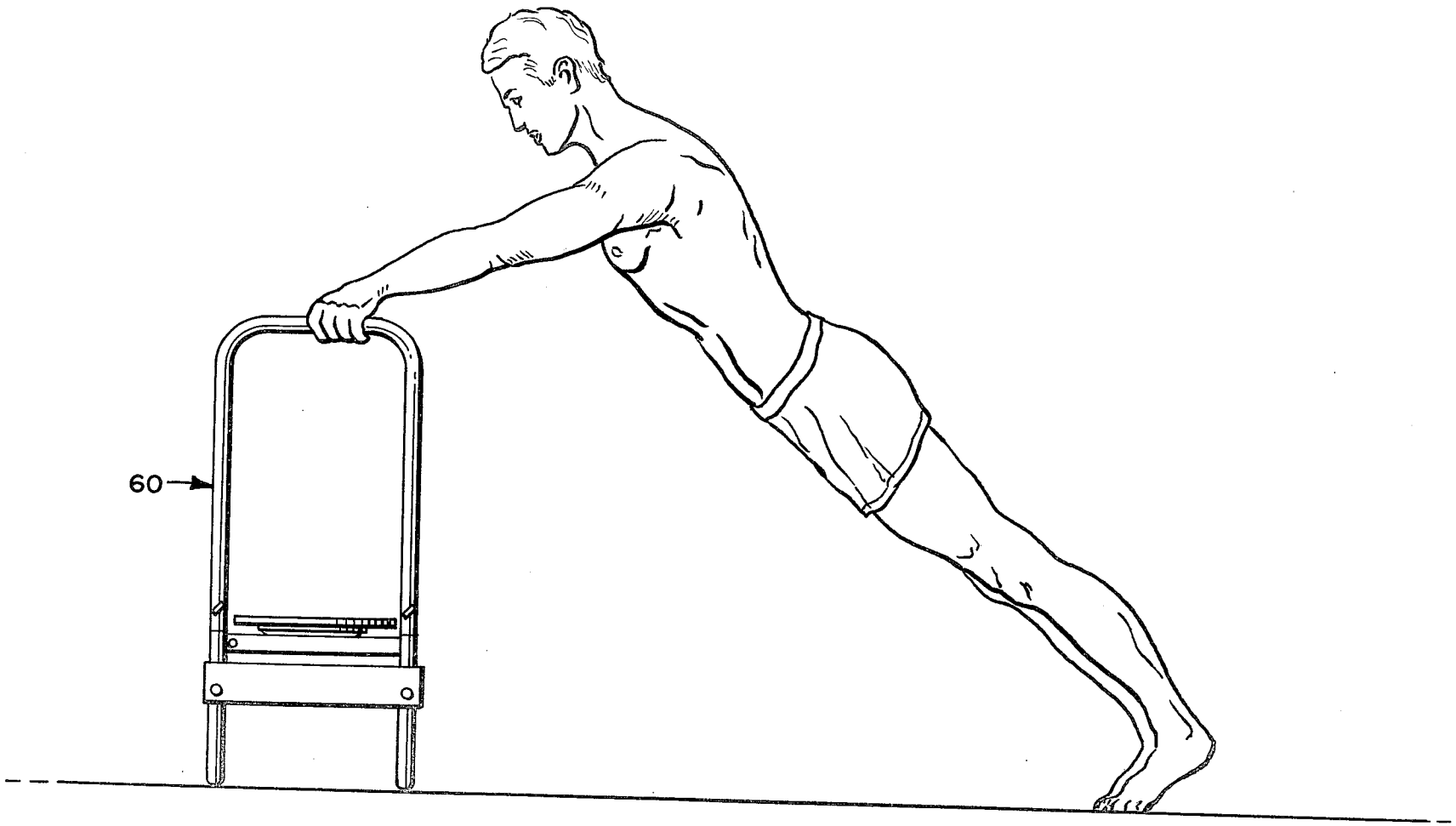

Positioned on each side of the two spaced removable rotating platforms are a pair of parallel hand gripping bars 32 for the performance of exercises as shown in FIGS. 12–14, and which afford a firm vertical support in the performance of other exercises. The hand gripping bars can be formed of an inverted U-shaped pipe member 34 having a fitting joint 33 which telescopingly connects to a vertical straight pipe 36 which extends from below the surface 16 of the base and which is further connected to a supporting pipe 38 attached to base 12. Bars 32 can be detached and re-attached or can be adjusted for height with ease by moving the U-shaped pipe member 34 up or down to a new fixed position (see FIGS. 2 and 3) and holding same by means of a screw and nut assembly 39 in holes in pipe member 34.

The jumping and running exercises as illustrated in FIG. 12 can be performed on a slightly slanted, flat, spring-biased running and jumping board 40 attached to the top surface 16 of the base 12 by a hinge 42. The running and jumping board 40 is positioned between the turning shaft sockets 23.

Figure 4:
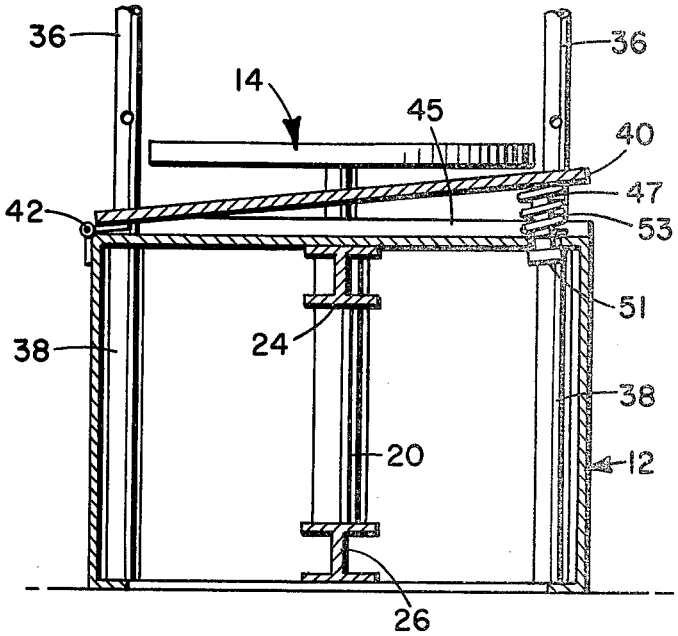
FIG. 4 is a cross-section taken along the line 4—4 of FIG. 1.
Figure 5:
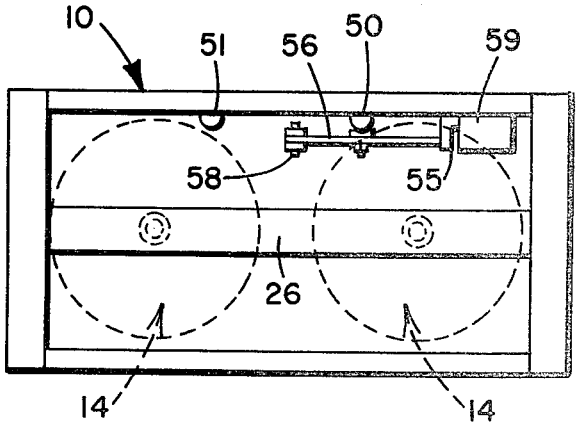
FIG. 5 is a bottom plan view of the exerciser device of FIG. 1.
Figure 6:
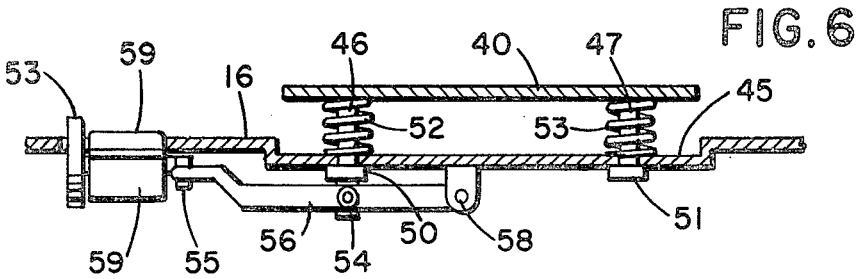
FIG. 6 is a sectional view taken along the line 6—6 of FIG. 1 showing the counter actuating mechanism.

As can be seen in FIGS. 4 and 6, positioned under board 40 is a pair of guide bolts 46,47 which are inserted into guide holes 48,49 in a recess 45 positioned in the middle of the top surface 16 in which the spring-biased running and jumping board operates.

Heads 50,51 of the guide bolts 46,47 limit the upward movement of board 40. Springs 52,53, surrounding bolts 46,47, respectively, positioned between the top surface 16 and the bottom surface of the board 40, provide upward spring bias to the board.

A conventional counting meter or means 59 is operatively positioned in the surface 16 to record the number of running steps or jumps. The attached meter 59 has a digital recording meter face **59*a***.

As the running and jumping board 40 is compressed by the person contacting the board, a pivotable connection 54 on the head of the guide bolt 50 pushes lever arm 56, pivotably attached to the base at one end 58. The other end of the arm 56 pushes the arm 55 of the counter meter 59 in a downward direction to actuate the meter. The digital change is shown on the meter face **59*a*. A reset wheel 53** is provided on the counter to adjust the counter to zero position after a jumping or running exercise has been completed.

Figure 10:
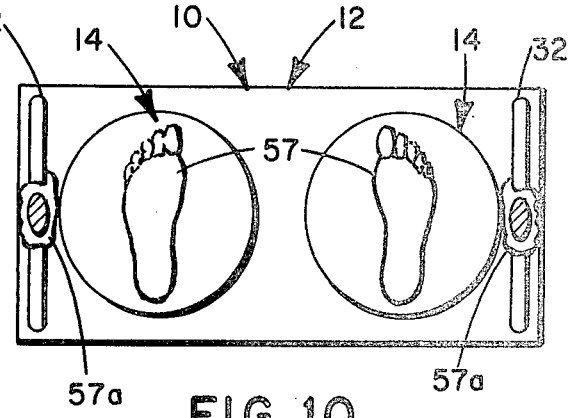
FIGS. 10 and 11 are representational view of the rotating platforms and the parallel hand gripping bars of the exerciser device used in the performance of twisting exercises.
Figure 11:
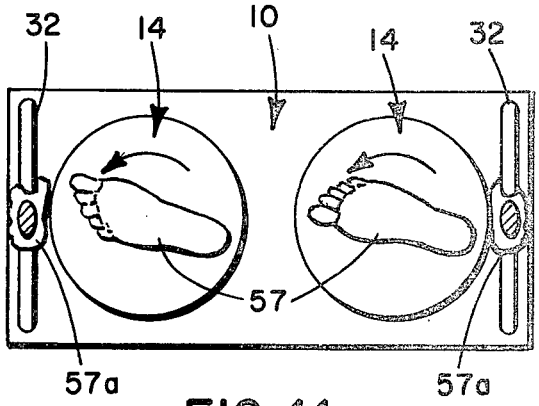

FIGS. 12–14 represent a few of the applications of jumping and parallel bar exercising that can be performed on this device while FIGS. 10 and 11 show a part of the twisting exercises where the feet 57 of a person rest on the rotating platforms 14 and the hands **57*a* are placed on the hand gripping bars 32. As the feet move in a counterclockwise direction, the platforms 14** also turn according to the voluntary movement of the feet.

Figure 7:
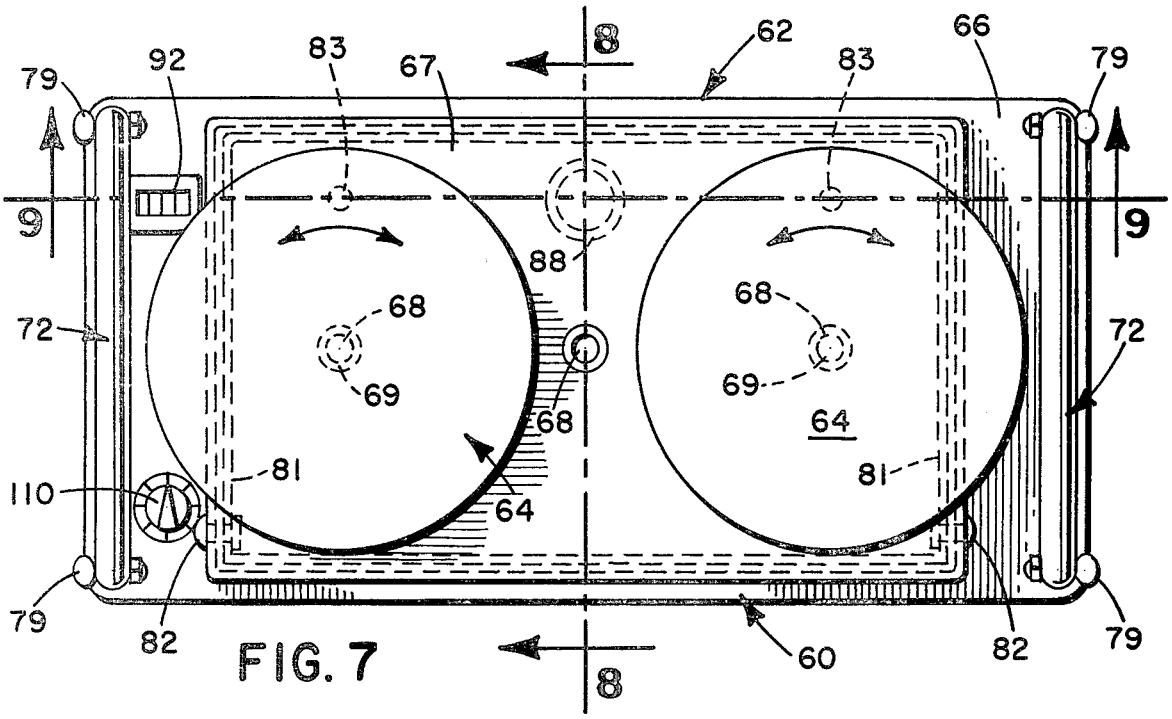
FIG. 7 is a top plan view of an alternate exerciser device constructed in accordance with the invention.
Figure 7A:
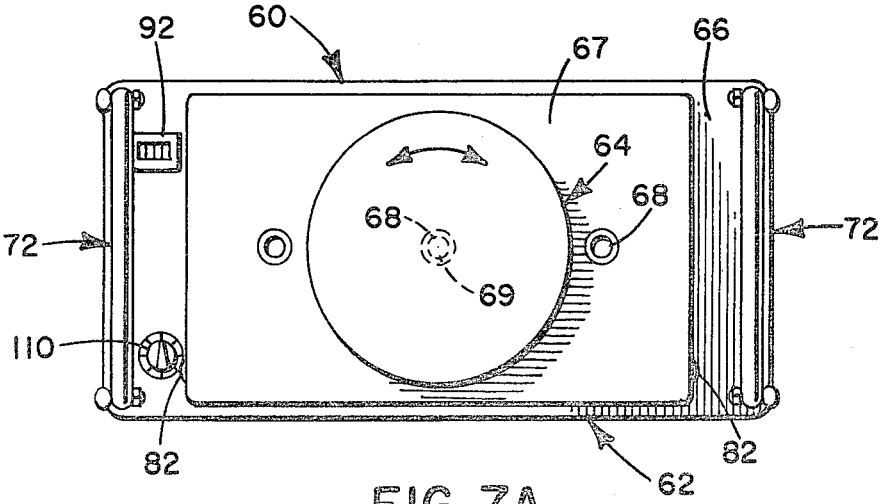
FIG. 7A is a top plan view showing the use of only one rotating platform.
Figure 8:
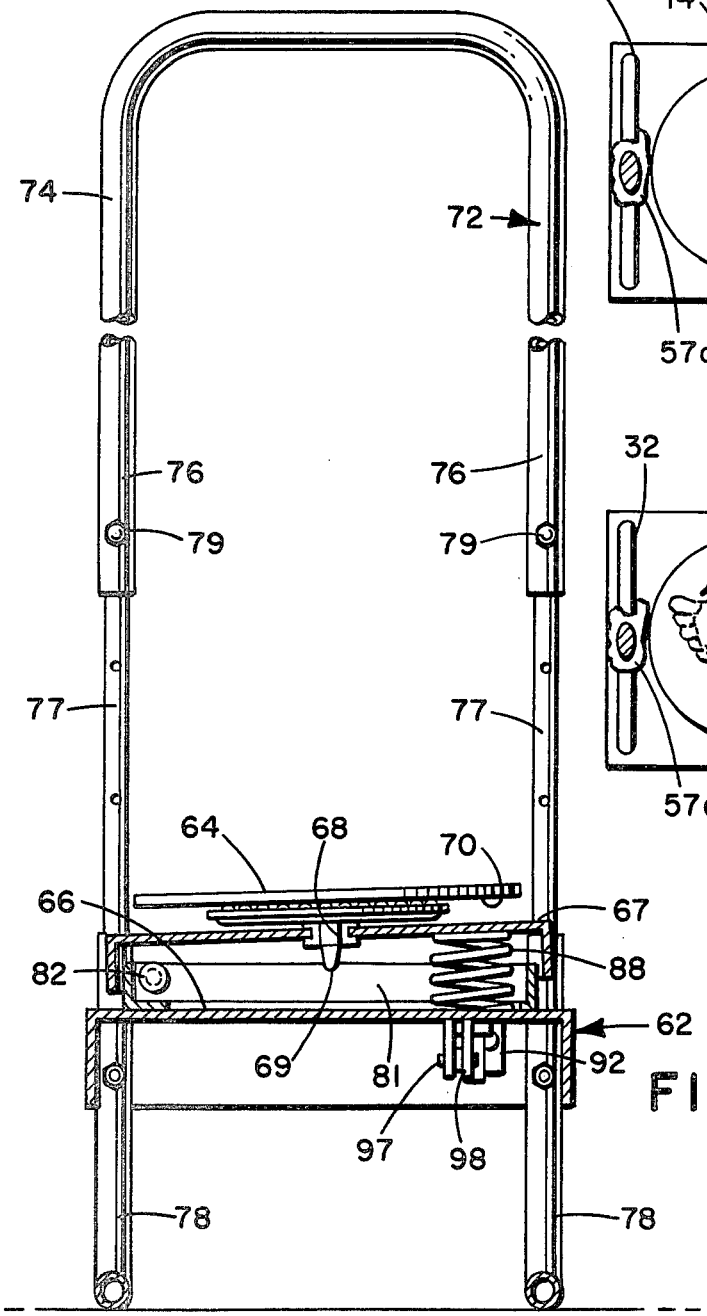
FIG. 8 is a vertical longitudinal sectional view taken along the line 8—8 of FIG. 7.
Figure 9:
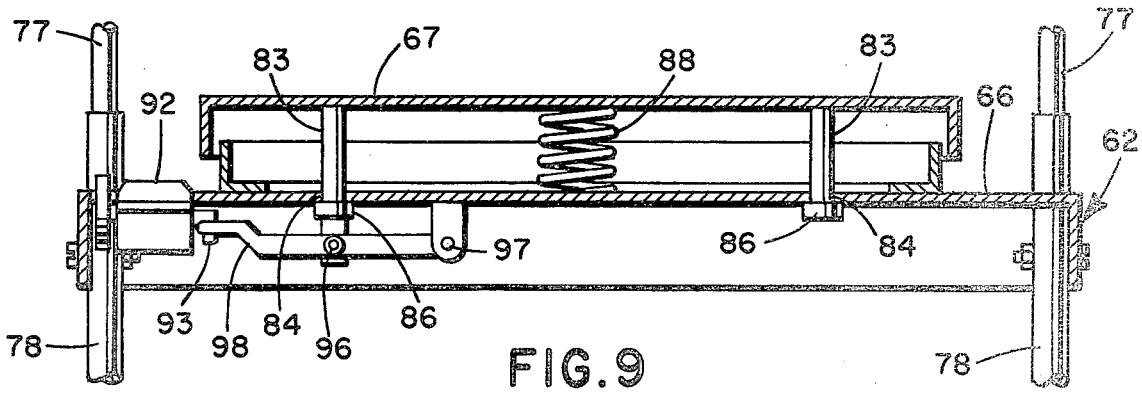
FIG. 9 is a sectional view taken along the line 9—9 of FIG. 7.

FIGS. 7 through 9 illustrate an alternate exerciser device 60 of this invention having a step-up supporting base 62 and a pair of removable rotating platforms 64. On a top surface 66 of base 62 is a running and jumping board 67. Three spaced holes 68 extend through board 67. Each rotating platform has a hub or extending turning shaft 69 centrally attached to the back surface 70 of the platform, and each shaft 69 is insertable through one of the holes 68. Either two platforms may be used as seen in FIG. 7, or only one as seen in FIG. 7A.

Hand gripping parallel bars 72 are positioned at each end of the supporting base for the performance of free hand exercises as shown in FIGS. 12 through 14. The bars render a firm vertical support in the performance of other related exercises and consist of an inverted U-shaped pipe member 74 having fitting joints 76 which connect to vertically straight pipes 77 which extend upwardly from the supporting base members 78. The pipes 74 and 77 can be detached and re-attached, or, adjusted for height with ease by the use of adjusting holes in pipes 77 located at convenient intervals of length, as previously described.

Screw and nut assemblies 79 secure members 74 at selected height as illustrated in FIG. 8.

The running and jumping exercises can be performed on a hinged jumping and running board which is operatively attached in a hinged position to the surface 66 of the base 62 via a pair of rivet-like studs 82, which pass through flange 81 to form a hinge for the running and jumping board 67 at one side of the board with the other sides free so that the board 67 can move continuously from an upwardly inclined position to a substantially horizontal position during the jumping exercises. A pair of guide bolts 83 are inserted in holes 84 in the surface 66 of the supporting base 62.

The heads 86 of the guide bolts 83 serve to limit upward movement of board 67 which is forced upward by spring 88.

The number of steps in the runs or jumps is counted by an operatively positioned digital counter meter 92.

As the running-jumping board 67 is forced down by the person, one of the guide bolts 83 pushes a pivotable fulcrum 96 of the lever arm 98 which is pivotably attached to base 62 at 97. This action in turn depresses the operating arm 93 of counter 92 to record a depression of the hinged board 67.

The rotating platform 69 can be formed of two discs with a bearing surface means positioned between them so that one disc can turn relative to the other. The bearing surface means can be a ring of ball bearings positioned in an annular raceway in the form of adjacent surfaces of the discs. In this type of construction, the turning shaft 69 is attached to the top disc and passes rotatably through the bottom disc with each ball bearing of the ring of ball bearings being equally spaced from the turning shaft 69 so that, when a turning force is applied on said platform, the discs are rotatable with respect to each other (see FIG. 8).

Advantageously, a timer mechanism 110 can be operatively positioned in the base 62 as an indicating control of the duration of the performance of the user (see FIG. 7).

In addition to the counting meter 92, a sound producing or projection means may be positioned in the supporting base 12 or 62 such as a cassette tape recorder attachment 102, which can be powered by a battery or by electrical current supplied from an electrical plug-in outlet through a plug and extension cord (not shown). The tape recorder attachment has manipulating buttons 104, an opening for tape insertions 106, and a speaker 108 which, when in operation, provides instructional material for carrying out a series of exercises in an organized pattern (see FIG. 3).

It should be understood that many other modifications and variations in the particular embodiments of the invention described can be made and the scope of the invention is limited only by the appended claims.

What is claimed is:

1. A multiple exerciser device comprising:

a raised supporting base having a horizontal top surface; a spring biased running and jumping board positioned on said top surface, said running and jumping board hinged at one side to said base; two removable rotatable exercising platforms having flat surfaces operatively connected to the top of said device and positioned above said running and jumping board, each of said platforms having a centrally positioned, vertically downward extending turning shaft; at least two vertically extending turning shafts receiving socket means, each of said socket means being adapted to removably receive one of said turning shafts, each of said turning shafts when positioned in one of said socket means providing a horizontally positioned flat platform surface rotatable over said running and jumping boards.

2. The multiple exerciser device of claim 1, in which said device has two removable platforms, said turning shaft of each platform adapted to be rotatably positioned in one of said receiving socket means, said receiving socket means being positioned in the top surface of said base on each side of said hinged running and jumping board.

3. The multiple exerciser device of claim 2, in which said socket means has a turnable thrust surface in each opening against which the end of said turning shaft bears and turns during rotational movement of said platform.

4. The multiple exerciser device of claim 2, in which said hinged running and jumping board is operatively positioned in a wide groove in the top surface of said base.

5. The multiple exerciser device of claim 1, in which three turning shaft receiving socket means are centrally positioned and in line parallel with the hinged side of said running and jumping board, one of said socket means being positioned substantially in the center of the jumping and running board and the end two socket means being positioned at a distance from each other greater than a diameter of said platforms.

6. The multiple exerciser of claim 5, in which each of said platforms is formed from two circular rotating discs having said turning shaft attached to a bottom disc with said top disc rotatably attached to said bottom disc.

7. The multiple exerciser device of claim 6, in which a bearing surface means is positioned between each of said discs forming said platform.

8. The multiple exerciser device of claim 7, in which said bearing surface means is a ring of ball bearings positioned in a raceway formed by the adjacent surface of said discs rotatable with respect to each other on said ball bearings when a turning force is applied on said platform.

9. The multiple exerciser device of claim 5, in which the bottom portion of said base has a pipe-supported construction.

10. The multiple exerciser device of claim 1, in which said base is a box-like structure having supporting strut members in the sides thereof to provide additional support to accommodate the weight of persons jumping up and down on said base.

11. The multiple exerciser device of claim 1, in which a parallel pair of hand gripping support bars are attached to said base, with said running and jumping board and said platform positioned therebetween.

12. The multiple exerciser device of claim 11, in which said hand gripping support bars have means for height adjustment.

13. The multiple exerciser device of claim 11, in which said hand gripping support bars are of a telescoping inverted U-shape with legs of the U-shaped telescoping pipe member having detent means for height adjustment.

14. The multiple exerciser device of claim 11, in which said hand gripping bars are detachable from said supporting base.

15. The multiple exerciser device of claim 1, in which a sound projection means is operatively positioned in said base for providing sound communication of programmed exercising patterns, rhythms and instructions to the user of said device.

16. The multiple exerciser device of claim 15, in which said sound projection means is a tape recorder.

17. The multiple exerciser device of claim 1, in which a performance duration means is operatively connected to said base.

18. The multiple exerciser device of claim 17, in which said performance duration means is a digital counter.

19. The multiple exerciser device of claim 17, in which the performance duration means is a timer.

* * * * *